US006846091B2

(12) United States Patent
Long

(10) Patent No.: US 6,846,091 B2
(45) Date of Patent: Jan. 25, 2005

(54) PORTABLE LANTERN

(75) Inventor: Norris Richard Long, Wichita, KS (US)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 10/255,003

(22) Filed: Sep. 24, 2002

(65) Prior Publication Data

US 2003/0017430 A1 Jan. 23, 2003

Related U.S. Application Data

(62) Division of application No. 09/371,336, filed on Aug. 10, 1999, now Pat. No. 6,485,290.

(51) Int. Cl.[7] ..... F21L 19/00

(52) U.S. Cl. ..... 362/159; 362/174; 362/319

(58) Field of Search ..... 362/159, 160, 362/164, 174, 175, 279, 179, 266, 327, 283, 303, 449, 319, 343, 347, 351, 323, 321, 322, 187, 188; D26/37, 39, 40, 41, 49, 118

(56) References Cited

U.S. PATENT DOCUMENTS

| | | | | | |
|---|---|---|---|---|---|
| 395,717 | A | * | 1/1889 | Baker | 188/174 |
| 793,103 | A | | 6/1905 | Scholtz | |
| 803,914 | A | | 11/1905 | Lungren | |
| 845,166 | A | | 2/1907 | Dixon | |
| 907,698 | A | | 12/1908 | Manshardt | |
| 1,906,255 | A | | 5/1933 | Engh | |
| 2,023,467 | A | | 12/1935 | Davis | |
| 2,092,116 | A | | 7/1937 | Hansen | |
| 2,253,018 | A | | 8/1941 | Cowles | |
| 2,263,659 | A | * | 11/1941 | Tullis | 362/179 |
| 2,299,643 | A | | 10/1942 | Moody | |
| 2,318,965 | A | | 5/1943 | Parker et al. | |
| 2,482,543 | A | * | 9/1949 | Jackson | 362/347 |
| 2,700,100 | A | * | 1/1955 | Wissinger | 362/147 |
| 2,805,089 | A | | 9/1957 | Hansen | |
| 2,914,344 | A | | 11/1959 | Anthes | |
| 3,314,696 | A | | 4/1967 | Ferguson et al. | |
| 3,450,424 | A | | 6/1969 | Calisher | |
| 3,529,911 | A | * | 9/1970 | Townsend | 431/107 |
| 3,534,988 | A | | 10/1970 | Lindsey | |
| 3,540,760 | A | | 11/1970 | Miller et al. | |
| 3,773,458 | A | * | 11/1973 | Spotts | 431/156 |
| 3,829,681 | A | * | 8/1974 | Fuss | 362/283 |
| 4,074,123 | A | * | 2/1978 | Wissinger | 362/319 |
| 4,089,635 | A | | 5/1978 | Sivignon | |

(List continued on next page.)

FOREIGN PATENT DOCUMENTS

| | | | |
|---|---|---|---|
| EP | 225305 | A | 6/1987 |
| GB | 1496777 | * | 6/1924 |
| GB | 2123105 | A | 1/1984 |

*Primary Examiner*—Thomas M. Sember
*Assistant Examiner*—Hargobind S. Sawhne
(74) *Attorney, Agent, or Firm*—Leydig, Voit & Mayer, Ltd.

(57) ABSTRACT

A lantern having a compact configuration. The lantern has a generally cylindrical shape with a lower housing containing a fuel tank, a shut-off valve and a regulator. A cap at the base of the lower housing can be removed, providing access to the fuel tank. The fuel tank is refillable via a fuel fill valve arranged at the base of the tank. A burner tube is coupled to the regulator and extends upwards beyond the housing. A mantle, which when lit provides illumination, is removably coupled to the upper end of the burner tube. A generally conical reflector is arranged around the burner tube below the mantle and above the regulator. A glass globe is arranged around the burner tube/mantle assembly and a ventilator cap is arranged above the globe. The ventilator cap attaches to rails which extend up from opposite sides of the lower housing and can be readily removed to access the mantle.

12 Claims, 8 Drawing Sheets

U.S. PATENT DOCUMENTS 4,230,446 A * 10/1980 Fisher ..... 431/123
4,278,276 A 7/1981 Ekman
4,535,390 A * 8/1985 Curtis et al. ..... 362/179
4,632,436 A 12/1986 Kimura
4,635,974 A 1/1987 Moussaian
4,874,174 A 10/1989 Kojima et al.
5,104,312 A 4/1992 Dowst et al.
5,274,609 A * 12/1993 Bradley ..... 362/179
5,294,092 A 3/1994 Wade et al.
D389,257 S * 1/1998 Eca et al. ..... D26/37
5,979,946 A 11/1999 Petersen et al.
D467,026 S * 12/2002 Parker ..... D26/118

* cited by examiner

PORTABLE LANTERN

REFERENCE TO RELATED APPLICATION

This application is a divisional application of U.S. patent application Ser. No. 09/371,336, filed Aug. 10, 1999, now U.S. Pat. No. 6,485,290 and incorporated herein by reference.

FIELD OF THE INVENTION

The present application relates to lanterns, particularly to portable, fuel-burning lanterns.

BACKGROUND INFORMATION

A conventional fuel-burning lantern typically comprises a refillable fuel storage tank, fuel delivery means, and a burner attached to the fuel delivery means. The burner typically comprises a mantle which when ignited with a fuel/air mixture provided by the fuel delivery means emits a bright light. The burner is usually covered by a transparent glass globe. Fuel typically used with such lanterns includes liquid propane, butane, white gas and gasoline.

Conventional fuel-burning lanterns can be quite bulky and are usually too large for storage in a small carrier such as a backpack. Their usually fragile construction also makes them susceptible to damage in transport and in use. Transporting a conventional lantern in a carrier typically requires that the lantern be placed within its own protective enclosure. Moreover, refueling is typically a messy procedure, usually requiring pouring a liquid fuel into an opening using a funnel. In the alternative, expendable fuel canisters are required, which can be quite costly.

SUMMARY OF THE INVENTION

In an exemplary embodiment, the present invention provides a rugged and compact lantern comprising a refillable fuel storage tank, a fuel delivery sub-system, a burner with a mantle and reflector, a globe, a ventilator with a heat shield, a plastic housing, movable shields to protect the globe in transport, and a bail for hanging and/or carrying the lantern.

In an exemplary embodiment, a lantern in accordance with the present invention comprises a novel structure which allows fast and easy assembly of the lantern with minimal tools.

In other aspects, the present invention provides a novel fuel-filling mechanism, a novel mechanism for removably attaching a mantle and a novel latch that is formed integrally with a plastic housing member.

A lantern in accordance with the present invention can be built compactly and at a low cost, while operating reliably and safely under a variety of conditions.

DETAILED DESCRIPTION

Figure 1:
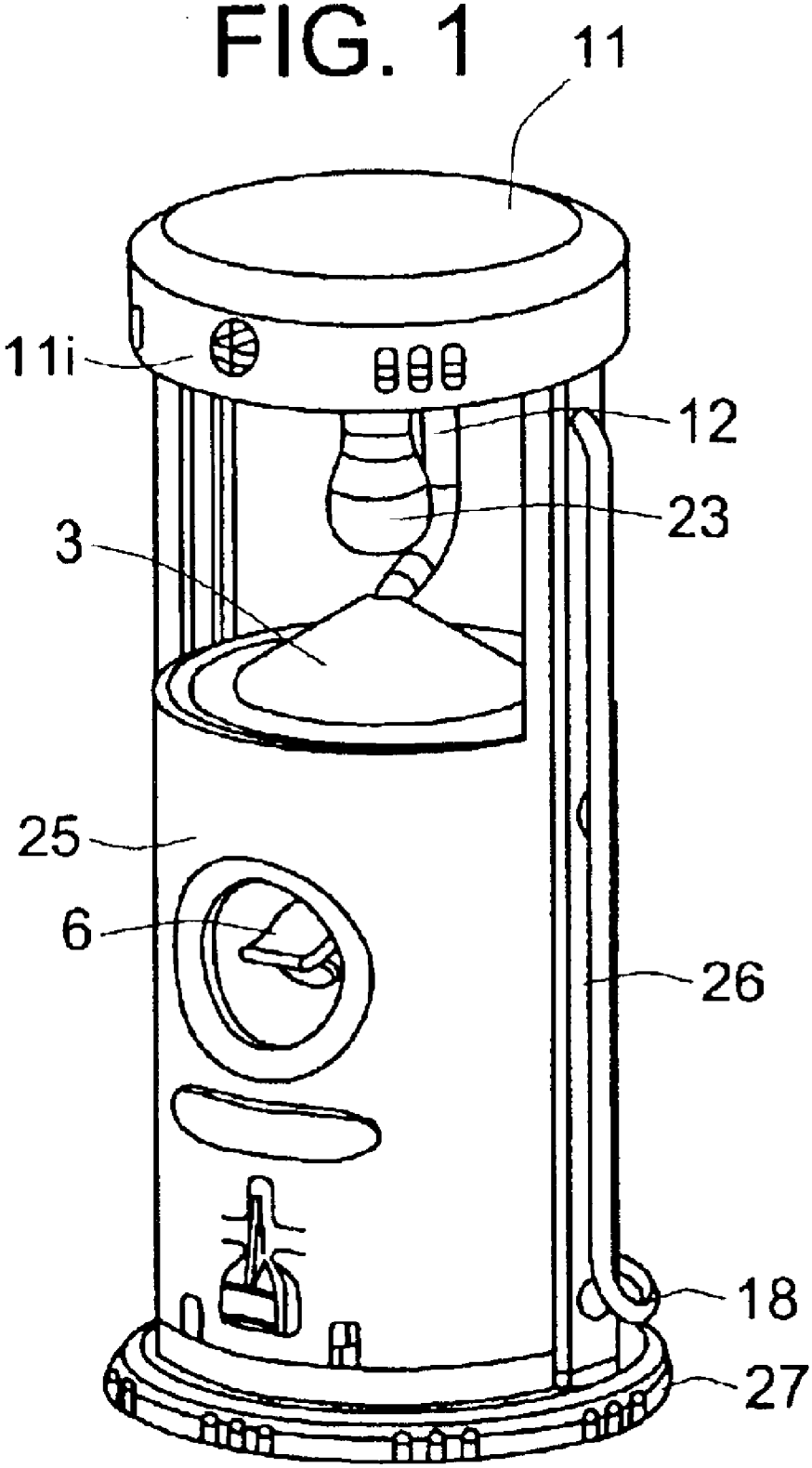
FIG. 1 shows a perspective view of an exemplary embodiment of a lantern in accordance with the present invention.

FIG. 1 shows a perspective view of an exemplary embodiment of a lantern in accordance with the present invention. As shown, the exemplary lantern has a generally cylindrical shape which is well-suited for such an application, although other shapes are possible within the scope of the present invention. The lantern comprises a globe 1 which encloses a burner tube 12 having a mantle 23 attached thereto. When lit, the mantle 23 provides illumination through the globe 1, which is preferably comprised of transparent glass. The mantle 23 is implemented in a known way, such as a fabric impregnated with yttrium oxide. The globe 1 and burner sub-assembly are arranged on a housing 25 which houses fuel storage and delivery sub-systems, described more fully below. A knob 6 is coupled to a fuel control valve for controlling the supply of fuel to the burner tube 12, and thus to the mantle 23. The housing 25 sits on a removable base 27. Removing the base 27 provides access to the fuel storage sub-system, as described below. The base 27 is preferably of a larger diameter than the rest of the lantern for improved stability against tipping over.

Two rails 26 are attached to opposite sides of the housing 25 and extend generally to the top of the lantern. A ventilator cap 11 is arranged at the top of the lantern, above the globe 1. A bail 18 for hanging or carrying the lantern is pivotally attached to the rails 26 proximate to the ventilator cap 11. As shown, the bail 18 can be implemented using a wire of suitable gauge and stiffness for carrying the weight of the lantern.

Figure 2:
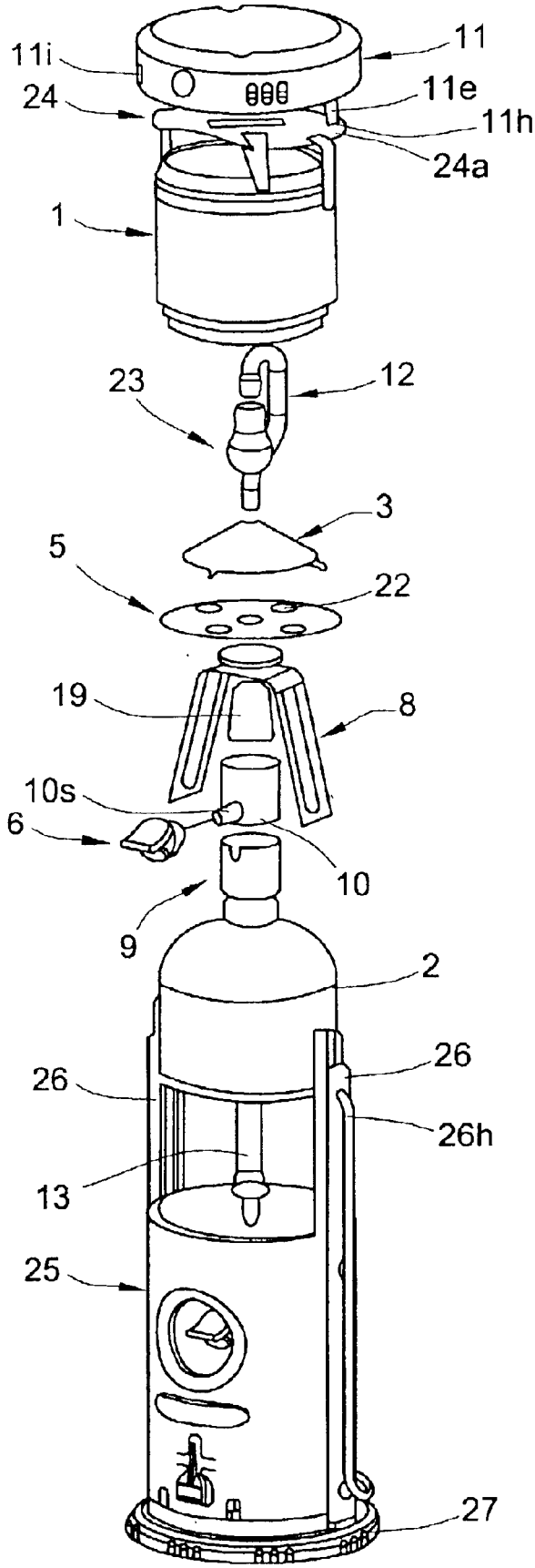
FIG. 2 shows a perspective exploded view of the exemplary lantern of FIG. 1.
Figure 3B:
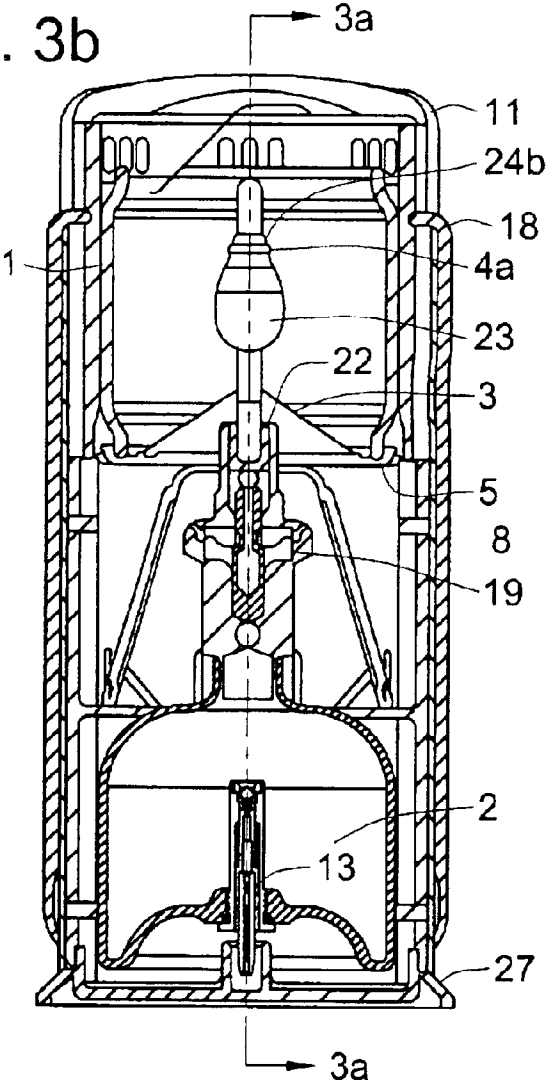
FIGS. 3A and 3B show cross-sectional views of the exemplary lantern of FIGS. 1 and 2.
Figure 3A:
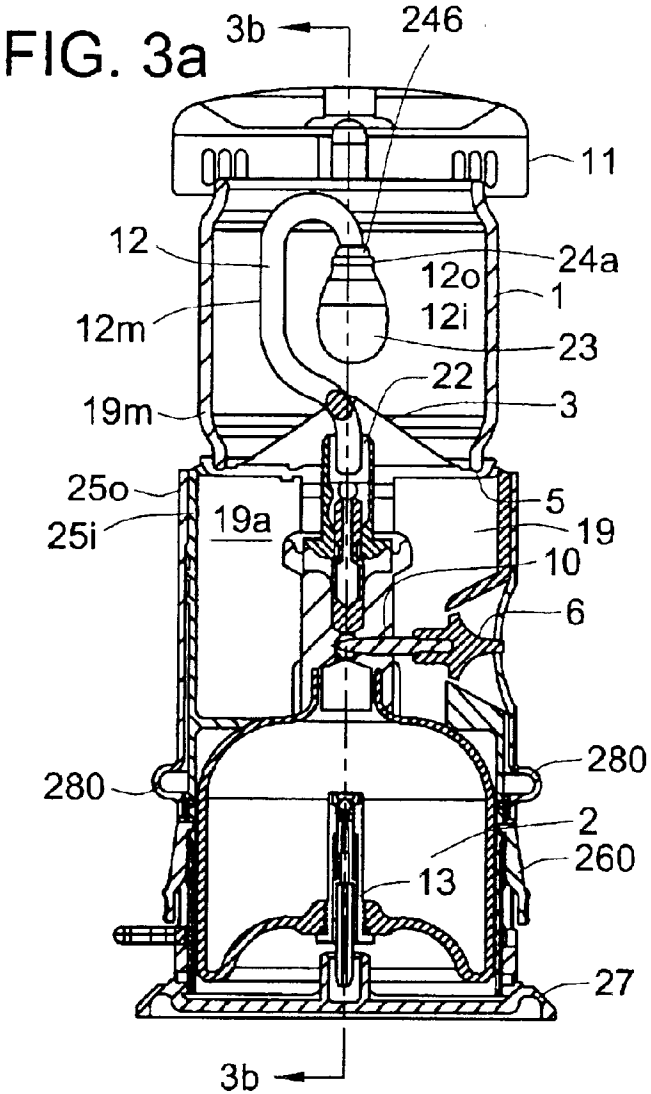

FIG. 2 shows an exploded perspective view of the exemplary lantern of FIG. 1. FIGS. 3A and 3B show cross-sectional views of the lantern. As shown in FIGS. 2, 3A and 3B the lantern comprises a fuel tank 2 located in a lower cavity of the housing 25. A fill valve 13 is provided in the tank 2 for filling the tank with fuel from an external fuel source. The fill valve 13 will be described more fully below. The fill valve 13 can be inserted and secured to the tank 2 such as by a threaded opening in the bottom of the tank.

The fuel tank 2 is removably coupled to a control valve 10, such as by a threaded coupling. The control valve 10 comprises a valve stem 10*s* by which the valve is operated. The valve stem 10*s* is typically threaded into the valve body so that its rotation is translated into a linear motion in or out of the valve. The valve stem 10*s* is coupled to the knob 6 which is accessible via an opening in the housing 25. A valve stem lock 9 is arranged between the tank 2 and the control valve 10 A slot in the valve stem lock 9 engages a circumferential slot in the valve stem 10*s* so as to limit the rotation of the valve stem 10*s*, thereby preventing the inadvertent removal of the valve stem 10*s* from the control valve 10.

The control valve 10 is coupled to a regulator 19. As shown, the control valve 10 and the regulator 19 can be formed as an integral unit. The control valve 10 and the regulator 19 operate and can be implemented in known ways.

The regulator 19 comprises one or more openings 19*a* for drawing primary air which is mixed with fuel delivered by the regulator. The air/fuel mixture exits through a further opening 19*m* at the top of the regulator 19. A first open end of the burner tube 12 is inserted into a bushing 22 which is inserted into the opening 19*m*. The bushing 22, which is preferably comprised of a plastic material, serves to support the burner tube 12 while thermally insulating the burner tube from the regulator 19, thereby minimizing heat transfer from the burner to the regulator. The burner tube 12 can readily be detached from the regulator by pulling it out of the bushing 22. The air/fuel mixture flows through the burner tube 12 and is combusted at the mantle 23 attached to the upper open end of the burner tube.

As shown in FIGS. 3A and 3B, the mantle 23 is attached to a mantle holder 24*a* in a known way, such as by tying the mantle to the holder 24*a* with a thread sewn around the opening of the mantle. The mantle holder 24*a* is, in turn, removably attached to a complementary coupling member 24*b* attached to the upper opening of the burner tube 12. The inner surface of the mantle holder 24*a* and the outer surface of the coupling member 24*b* may be threaded so as to allow the holder to be screwed onto the coupling. An alternative coupling arrangement is described below. The coupling member 24*b* can be attached to the burner tube 12 such as by soldering, welding or other appropriate attachment techniques.

As shown in FIG. 3A, the burner tube 12 is bent in three places so that the intake end 12*i* of the tube and the outlet end 120 of the tube are substantially parallel and face the same direction. The bends should be of sufficient radius so as to provide ample clearance between the mantle 23, which becomes very hot when lit (e.g., 2000–2500 F) and a middle portion 12*m* of the burner tube.

Figure 4:
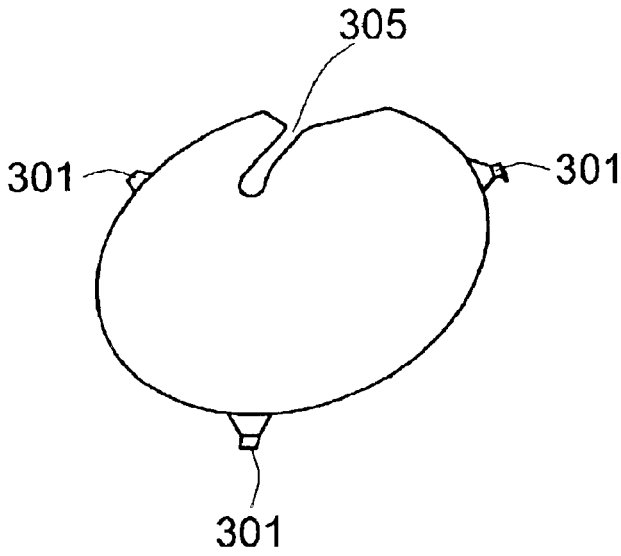
FIG. 4 shows a perspective view of a reflector for an exemplary embodiment of a lantern in accordance with the present invention.

A reflector 3 having a substantially conical shape is arranged at the base of the globe 1 and substantially surrounds the lower end of the burner tube 12. FIG. 4 shows the reflector 3 in perspective view. The reflector rests on a circular plate 5 which is mounted on the regulator 19 and supported by a bracket 8 which is braced on features formed in the interior of the housing 25. As shown in FIG. 4, the reflector 3, along the perimeter of its base, comprises a plurality of ears 301 which project radially from the reflector. The reflector 3 is removably attached to the plate 5 by placing the ears 301 in mating openings arranged in the plate 5. In order to get the ears into their respective openings, the reflector 3, which is preferably comprised of a spring steel, is temporarily deformed. Upon releasing the reflector 3, the reflector returns to its original shape and is held to the plate 5 by the ears 301. To remove the reflector 3 from the plate 5, the reflector must be temporarily deformed to allow the ears 301 to clear the openings in the plate 5. In an alternative embodiment, the ears 301 are held down onto the plate 5 by the rim of the globe 1 when the lantern is assembled.

As shown in FIG. 4, the reflector 3 has a slit 305 extending radially outward from the center of the reflector for receiving therethrough the burner tube 12. Where the burner tube 12 passes through the reflector 3, the tube 12 is preferably crimped (as shown in FIG. 3B). The slit 305 in the reflector 3 is just wide enough to accept the crimped portion of the tube 12. As such, when the reflector 3 is secured to the plate 5, the reflector holds down the burner tube 12 in the bushing 22 arranged in the regulator opening 19*m*.

The reflector 3 redirects light that is cast downward from the mantle 23—light that would otherwise be lost—outward from the lantern, thereby providing more useful light (e.g., 10% more) to the lantern user. Additionally, the reflector acts to shield the regulator 19 from dangerously hot gases which may be emitted downward by the mantle 23, particularly if the mantle were to develop a hole in its bottom.

The globe 1 rests on the plate 5, and as mentioned, may be used to hold the reflector 3 down onto the plate. The globe 1 is held down by a support member 24 which is in turn held down by the ventilator cap 11. The member 24 comprises one or more resilient arms 24*a* which press down on the upper rim of the globe 1. The support member 24 also serves as a heat shield to shield the ventilator cap 11, which is exposed, from heat emitted by the mantle 23.

The ventilator cap 11 comprises two ears lie which extend downwards from the lower periphery of the cap 11 and align with the rails 26. When the cap 11 is placed on the rails 26, a hole 11*h* in each of the ears lie is aligned with a matching hole 26*h* in the corresponding rail 26. The ventilator cap 11 is held to the rails 26 by passing the free ends of the bail 18 through the holes 26*h* in the rails and the holes 11*h* in the ears lie. The cap 11 and globe 1 can thus be readily removed from the lantern for quick access to the mantle 23 by removing the bail 18 such as by flexing apart the free ends of the bail.

The cap 11 also includes a lighting hole 11*i*, as shown in FIG. 1. The lantern can be lit by turning the knob 6, so as to provide fuel to the mantle 23, and inserting a lit match, or the like, into the lighting hole 11*i*. The lantern of the present invention can also be adapted to employ other ignition means such as an electrical ignition.

Figure 5B:
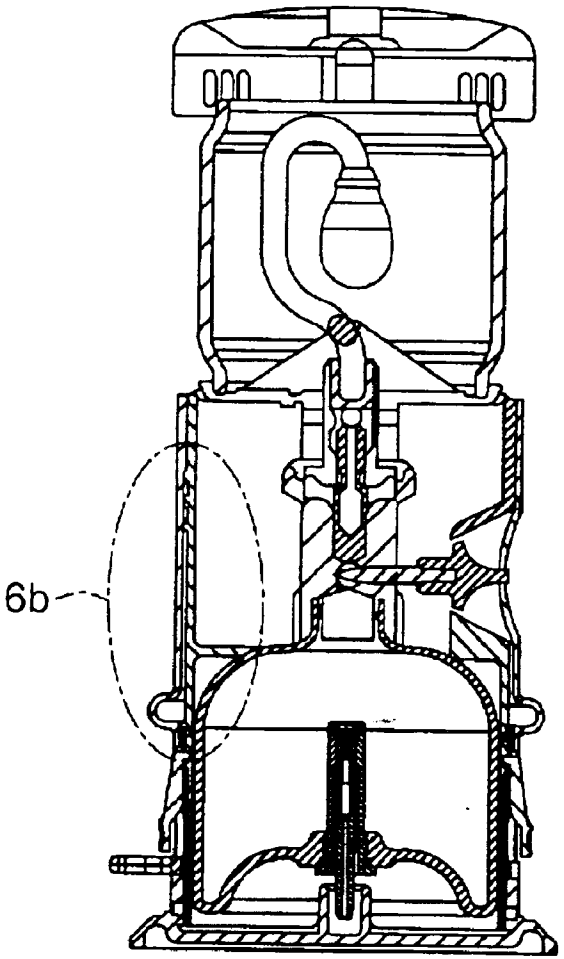
FIGS. 5A and 5B show a side view and a cross-sectional view respectively, of an exemplary embodiment of a lantern in accordance with the present invention comprising a slidable shield which is shown in a raised position.
Figure 5A:
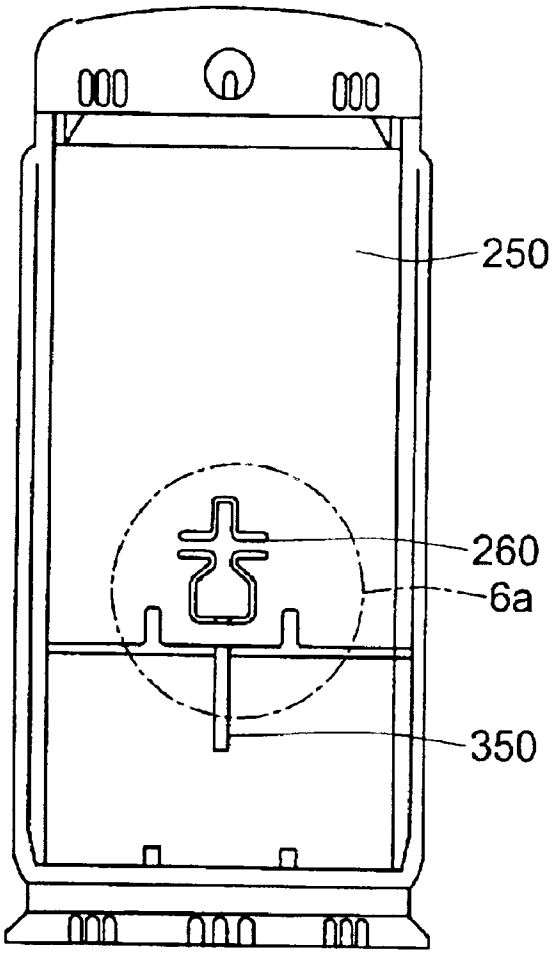
Figure 6A:
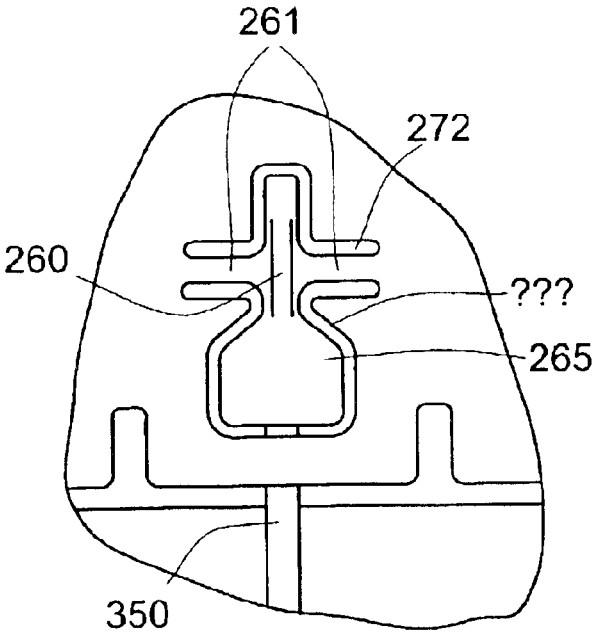
FIGS. 6A and 6B show a side view and a cross-sectional view respectively, of a latch mechanism of an exemplary embodiment of a lantern in accordance with the present invention.

As mentioned, a housing 25 encases the fuel delivery and storage sub-systems of the lantern. In an exemplary embodiment, the housing 25 comprises an inner, generally cylindrical shell 25*i* and two outer arcuate parts 25*o* which together define an outer, generally cylindrical shell surrounding the inner shell 25*i*. The two outer housing shells 25*o* are slidably coupled to the rails 26 and can each be slid up to cover the globe 1, as shown in FIG. 5A. FIG. 5B is a cross-sectional view showing one of the outer shells 25*o* raised up to cover the globe 1 and one of the shells 25*o* in the lowered position Each outer shell cart 25*o* is provided with a latch 260 shown in detail in FIGS. 6A and 6B. The latch 260 is integrally molded as part of the outer shell part 25*o*, which is preferably comprised of a plastic material. As shown in FIG. 6A, slits 271 and 272 are formed around the latch 260, leaving the latch 260 attached to the shell 25*o* by two arm-like connections 261. This arrangement allows the latch 260 to pivot resiliently about the arms 261.

Figure 6B:
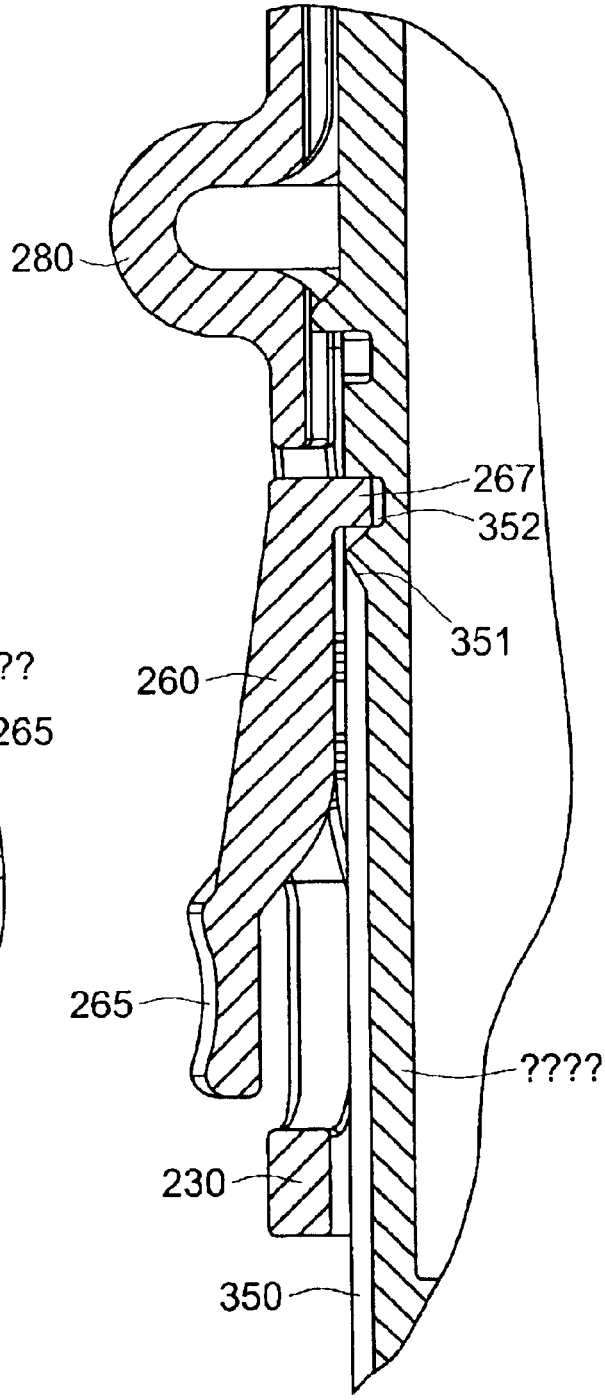

As shown in cross-section in FIG. 6B, the latch 260 comprises, at a lower end, a pad 265 which projects outward from the outer shell 25*o* and, at an upper end, a projection 267 which projects inward from the outer shell 25*o*. The projection 267 can slide freely in a channel 350 formed on the outer surface of the inner shell 25*i*. At an upper end of the channel 350, a mound 351 defines an indent 352 in which the projection 267 is held when the outer shell 25*o* is slid to its uppermost extent (as shown in FIG. 5A). When sliding the outer shell 25*o* up, the projection 267 rides in the channel 350 until it encounters the mound 351. At that point, the projection 267 jumps the mound 351, causing the latch 260 to pivot about the arms 261, and is captured in the indent 352, preventing further upward movement of the outer shell 250. Pressing the pad 265 causes the latch 260 to pivot about the arms 261 pulling the projection 267 outward, away from the inner shell 25*i*. While the pad 265 is pressed, and the projection 267 thus released from the indent 352, the outer shell 25*o* can be slid down, exposing the globe 1. The outer shell 25*o* preferably includes a raised feature 280 to assist in sliding the shell. At least one of the outer shells 25*o* may also include a reflector on its inner surface so as to reflect light emitted by the mantle when the outer shell is in the raised position.

Figure 7:
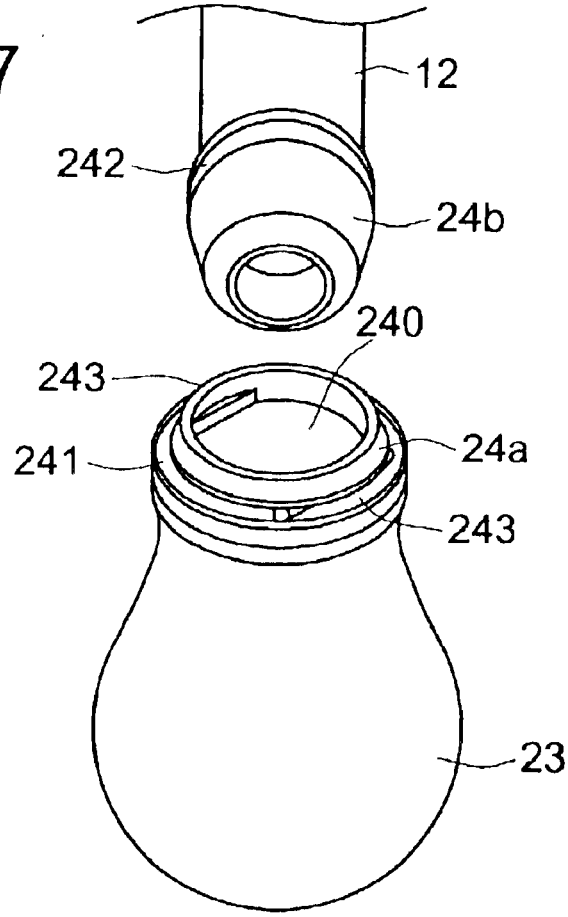
FIG. 7 shows a perspective view of a mantle holder and a burner tube of an exemplary embodiment of a lantern in accordance with the present invention.
Figure 8:
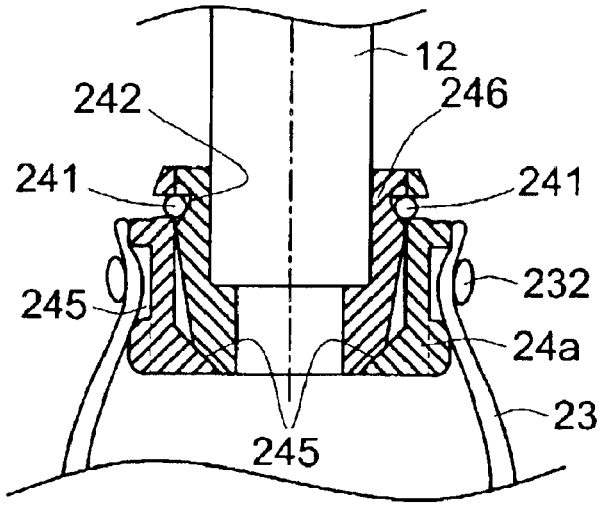
FIG. 8 shows a cross-sectional view of a mantle holder attached to a burner tube of an exemplary embodiment of a lantern in accordance with the present invention.

As discussed above, the mantle holder 24*a* is removably attached to the coupling member 24*b* at the outlet end of the burner tube 12. FIGS. 7 and 8 illustrate an improved alternative arrangement for removably coupling the mantle holder 24*a* and the coupling member 24*b* in accordance with the present invention. As shown in perspective view in FIG. 7, the mantle holder 24 comprises an opening 240 for receiving therein the coupling member 24*b*. The mantle holder 24*a* further comprises a spring member 241 which engages a groove 242 in the coupling member 24*b* when the mantle holder 24*a* and the coupling member 24*b* are joined. The spring member 241, which can be implemented for instance as a split ring with two straight sections, is arranged on the mantle holder 24*a* with the two straight sections being seated in slots 243 formed into the sides of the mantle holder opening 240 so that the two straight sections of the spring member 241 project into the mantle holder opening.

FIG. 8 shows a cross-sectional view of the mantle holder 24*a* and the coupling member 24*b* when joined. As the coupling member 24*b* is inserted into the mantle holder opening 240, the straight sections of the spring member 241 are first pushed outward and then spring back inward into the groove 242 when the mantle holder 24*a* is fully inserted. As shown in FIG. 8, when the coupling member 24*b* is fully inserted into the mantle holder 24*a*, the spring 241 is still slightly deformed and continues to apply an inward pressure on the coupling member 24*b*. The narrowest point of the groove 242 is slightly above the point at which the spring 241 contacts the coupling member 24*b*. As a result, when the coupling member 24*b* is fully inserted into the mantle holder 24*a*, the spring 241, which is attached to the mantle holder, continues to apply a pulling force on the coupling member, thereby resiliently maintaining the two parts in contact. The mantle holder 24*a* is removed from the coupling member 24*b* by simply pulling the mantle holder downward, forcing the spring 241 to open and thus releasing the mantle holder from the coupling member.

Furthermore, as shown in FIG. 8, when the coupling member 24*b* is fully inserted into the mantle holder 24*a*, the two parts are in contact only along a relatively small surface area 245. This reduces the possibility of the two parts being unintentionally joined together by corrosion build-up, as is common with threaded couplings.

The mantle coupler 24*a* preferably comprises a circumferential groove 245 on its exterior, as shown in FIG. 8. The mantle 23 can be attached to the mantle holder 24*a* by placing the top end of the mantle around the mantle holder 24*a* and tying a thread, wire or other appropriate tying means 232 over the mantle, around the groove 245.

As discussed, a fill valve 13 is provided in the tank 2 for filling the tank with fuel from an external fuel source, such as a POWERMAX liquid propane dispenser, available from the Coleman Company of Wichita, Kans. The fill valve 13 will now be described with reference to FIGS. 9A and 9B. FIG. 9A is a cross-sectional view showing the fill valve 13 in the closed position, such as before or after the tank 2 has been filled. FIG. 9B is a cross-sectional view showing the fill valve 13 in the open position, such as when the tank 2 is being filled.

Figure 9C:
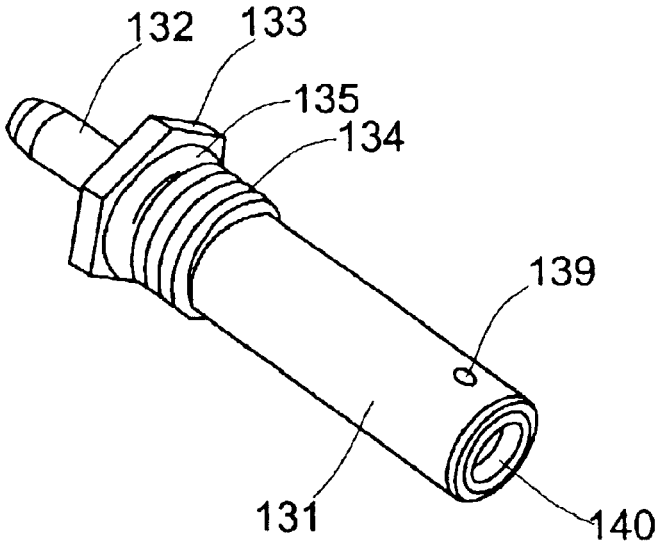
FIGS. 9A, 9B and 9C show cross-sectional and perspective views of a fuel filler valve of an exemplary embodiment of a lantern in accordance with the present invention.
Figure 9A:
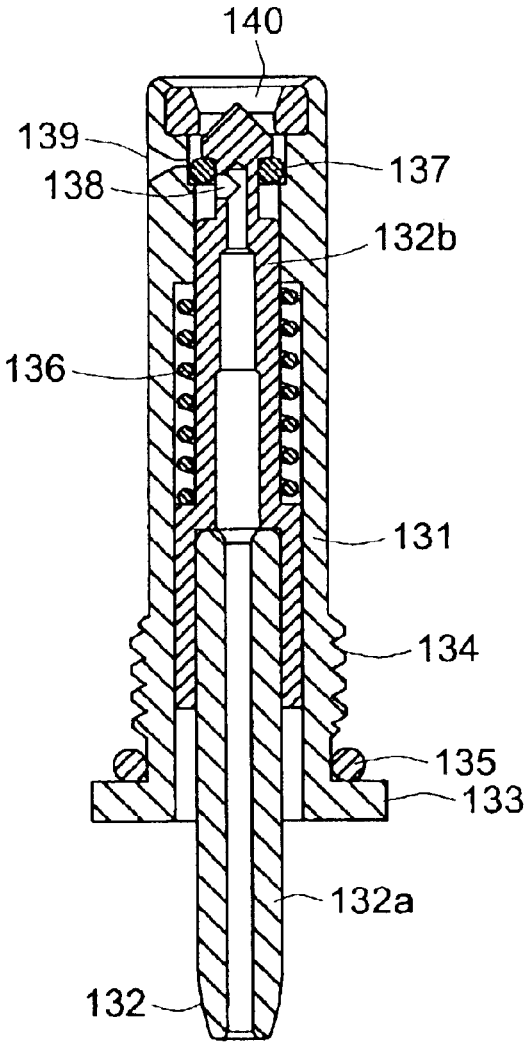
Figure 9B:
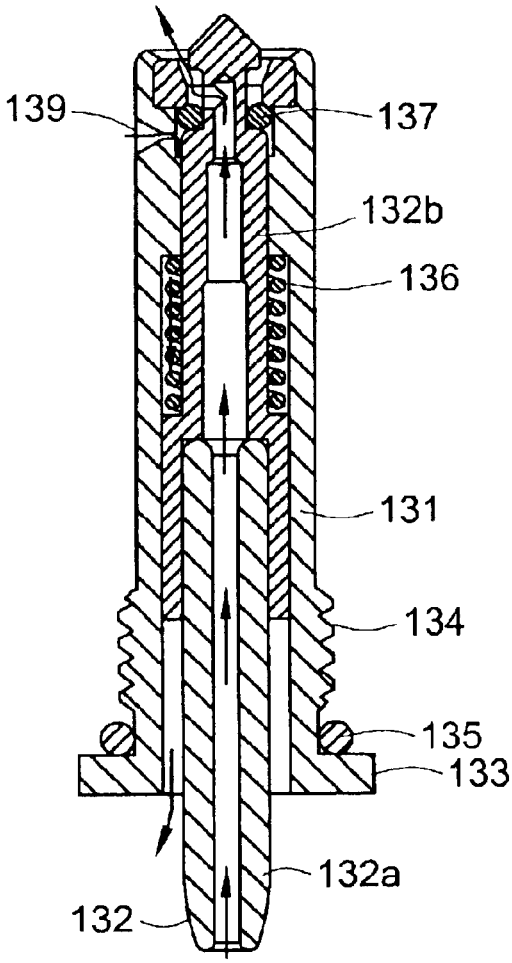

As shown in perspective view in FIG. 9C, the valve 13 comprises a generally cylindrical body 131 which is open at both ends, and a co-axial probe assembly 132 which slides within the body 131 and extends partially out of the bottom open end of the body. A portion 134 of the exterior of the valve body 131 proximate to the base 133 of the valve body is threaded. The base 133 of the valve body 131 is preferably formed as a hex nut, or the like, for screwing the valve 13 into a complementary threaded opening in the bottom of the tank 2. An O-ring 135 is provided between the valve base 133 and the threaded portion 134 for sealing purposes.

The probe assembly 132 comprises a filler tube 132*a* and a valve member 132*b*, which has a substantially hollow body. A spring 136 biases the probe assembly 132 downwards, to the closed position shown in FIG. 9A. An O-ring 137 arranged around a narrowed portion of the valve member 132*b* retains the probe assembly 132 within the valve body 131 and provides a seal between the valve member 132*b* and the valve body 131 in the closed position. In the open position, shown in FIG. 9B, the probe assembly 132 is pushed up and into the valve body 131, against the biasing force of the spring 136. In this case, fuel, which is under pressure, passes through the filler tube 132*a* and valve member 132*b* and exits a port 138 on the aforementioned narrowed portion of the valve member 132*b*. The path of the fuel is indicated by arrows. The pressurized liquid fuel is thus sprayed into the fuel tank 2 via the top opening 140 of the filler valve 13.

As shown in FIGS. 9A–9C, an orifice 139 is provided on the side of the valve body 131. While the tank 2 is being filled with fuel, any air in the tank is displaced by the fuel and exits the tank via the orifice 139, as indicated by arrows. Once the level of fuel in the tank 2 has reached the level of the orifice 139, the fuel, under pressure, enters the orifice 139 and travels between the valve body 131 and probe assembly 132 to the exterior. This passage of fuel creates an audible, visual and tactile indication that the fuel filling process is to be stopped. At this point, the tank 2 is preferably only partially full (e.g., 60%). As is well known, liquid fuels such as propane and butane have large expansion coefficients so that completely filling an enclosed tank with such fuel can present an explosion hazard. The disclosed arrangement thus prevents the occurrence of such a condition.

Unless disclosed otherwise, the various components of the lantern of the present invention can be implemented using a variety of materials, as appropriate for the component functions and familiar in the art.

What is claimed is:

1. A lantern comprising:

a fuel storage subsystem;

a fuel delivery subsystem;

a housing, the housing containing the fuel storage and fuel delivery subsystems and including two rails arranged on opposite sides of the housing;

a burner, the burner being coupled to an outlet of the fuel delivery sub-system;

a reflector, the reflector being arranged between the burner and the fuel delivery sub-system;

a globe, the globe surrounding the burner;

a ventilator cap, the ventilator cap being arranged above the globe; and a bail, the bail having two free ends which secure the ventilator cap to the rails.

2. The lantern of claim 1, wherein the fuel storage subsystem includes a refillable tank, the refillable tank including a fuel fill valve.

3. The lantern of claim 1, wherein the fuel delivery subsystem includes a fuel control valve and a regulator.

4. The lantern of claim 1, wherein the burner includes a tube and a mantle, the tube being removably coupled to the fuel delivery subsystem and the mantle being removably coupled to the tube.

5. The lantern of claim 1, wherein the reflector has a substantially conical shape and an opening for receiving the burner therethrough, the reflector substantially surrounding a lower portion of the burner.

6. The lantern of claim 1, comprising a shield arranged between the globe and the ventilator cap, the shield resiliently pressing down on the globe.

7. A lantern, comprising:

a frame;

a burner operatively associated with the frame;

a globe surrounding the burner;

a first panel slidingly mounted on the frame between a first position in which a first portion of the globe is exposed and a second position in which at least the first portion of the globe is covered by the first panel; and a releasable locking mechanism comprising a latch formed integrally on the first panel, the releasable locking mechanism being configured to releasably lock the panel in the first position.

8. The lantern of claim 7, wherein the latch comprises a press pad and a catch connected on a rocker arm, the rocker arm being mounted for pivoting movement on the first panel, and the catch being arranged so that it may latch over a protrusion when the first panel is in the second position.

9. The lantern of claim 7, wherein the first panel includes reflective material on an inner surface, the inner surface being exposed toward the globe when the first panel is in the second position.

10. The lantern of claim 7, wherein the first panel comprises plastic, and wherein the latch is formed by slits in the plastic that permit the latch to pivot relative to the panel.

11. The lantern of claim 7, wherein the first panel comprises a protrusion on the first panel to aid in moving the first panel between the first and second positions.

12. A lantern, comprising:

a frame comprising two vertical rails;

a burner operatively associated with the frame;

a globe surrounding the burner;

a first panel having two side edges, each side edge being slidingly mounted in one of the rails on the frame between a first position in which a first portion of the globe is exposed and a second position in which at least the first portion of the globe is covered by the first panel; and a second panel having two side edges, each side edge being slidingly mounted in one of the rails on the frame between a first position in which a second portion of the globe is exposed and a second position in which at least the second portion of the globe is covered by the first panel.

* * * * *